United States Patent [19]

Gobis

[11] Patent Number: 4,627,357

[45] Date of Patent: Dec. 9, 1986

[54] AMMUNITION PROJECTILE

[76] Inventor: Pranas Gobis, 6849 Vernon, Dearborn Heights, Mich. 48127

[21] Appl. No.: 654,971

[22] Filed: Sep. 27, 1984

[51] Int. Cl.[4] ..... F42B 11/00

[52] U.S. Cl. ..... 102/503; 244/3.23

[58] Field of Search ..... 102/501, 503; 244/3.23

[56] References Cited

U.S. PATENT DOCUMENTS

| | | | |
|---|---|---|---|
| 14,742 | 4/1856 | Smith | 244/3.23 |
| 183,009 | 10/1876 | Kellogg | 244/3.23 |
| 517,560 | 4/1894 | Ashley | 244/3.23 |
| 730,308 | 6/1903 | Stendebach | 244/3.23 |
| 1,288,883 | 12/1918 | Harvey | 244/3.23 |
| 3,062,145 | 11/1962 | Morgan et al. | 102/439 X |
| 4,016,817 | 4/1977 | Blanco | 244/3.23 |
| 4,413,564 | 11/1983 | Brown | 244/3.23 |

FOREIGN PATENT DOCUMENTS

| | | | |
|---|---|---|---|
| 408842 | 4/1910 | France | 244/3.23 |
| 257282 | 2/1928 | Italy | 244/3.23 |

*Primary Examiner*—Harold J. Tudor

*Attorney, Agent, or Firm*—Gifford, Groh, VanOphem, Sheridan, Sprinkle & Dolgorukov

[57] ABSTRACT

The present invention provides a projectile for a shotgun having an elongated cylindrical body with an axial throughbore. A helix is contained within the throughbore which, in conjunction with external fins circumferentially spaced around the exterior of the body, impart spin to the projectile when it is fired.

5 Claims, 3 Drawing Figures

AMMUNITION PROJECTILE

BACKGROUND OF THE INVENTION

I. Field of the Invention

The present invention relates generally to ammunition and, more particularly, to a projectile for a shotgun.

II. Description of the Prior Art

The previously known shotgun shells typically comprise a tubular casing in which both the explosive charge and the shot are contained. The shot typically comprises a plurality of pellets which, upon firing of the shotgun, are discharged out through the end of the shotgun barrel.

These previously known shotgun shells produce a wide dispersion of the shot and, for that reason, are effective at only a relatively short range.

Some previously known shotgun shells have used slugs rather that shot. These slugs, however, have not proven accurate at long ranges.

SUMMARY OF THE PRESENT INVENTION

The present invention provides an ammunition projectile which is highly accurate at long ranges.

In brief, the shotgun projectile or shot of the present invention comprises an elongated cylindrical body having an axial throughbore. A helical fin is contained within the throughbore so that, during flight of the projectile, the helical fin imparts rotational spin to the projectile, thereby increasing its long range accuracy.

In addition, in the preferred form of the invention, a plurality of angled fins are formed externally along the outer periphery of the projectile which also impart spin to the projectile during flight.

BRIEF DESCRIPTION OF THE DRAWING

A better understanding of the present invention will be had upon reference to the following detailed description when read in conjunction with the accompanying drawing, wherein like reference characters refer to like parts throughout the several views and in which.

DETAILED DESCRIPTION OF A PREFERRED EMBODIMENT OF THE PRESENT INVENTION

Figure 1:
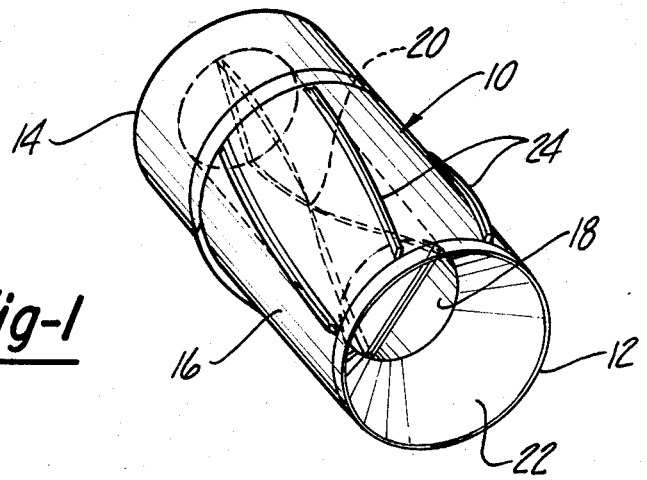
FIG. 1 is a perspective view illustrating a preferred embodiment of the present invention.
Figure 2:
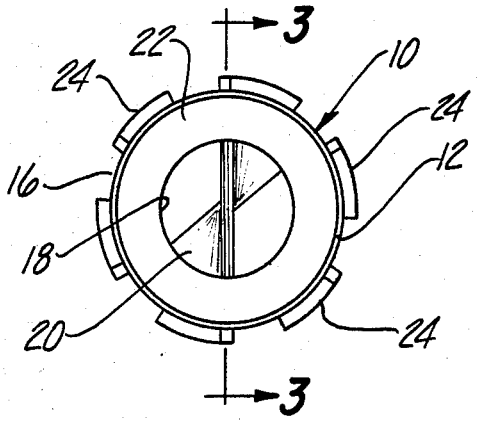
FIG. 2 is a front end view of the preferred embodiment of the present invention.

With reference first to FIGS. 1 and 2, a preferred embodiment of the ammunition projectile of the present invention is thereshown and comprises an elongated cylindrical body 10 having a front end 12, a rear end 14 and an outer periphery 16. The body 10, furthermore, is dimensioned to fit within a standard cartridge or casing (not shown) for a shotgun shell.

Figure 3:
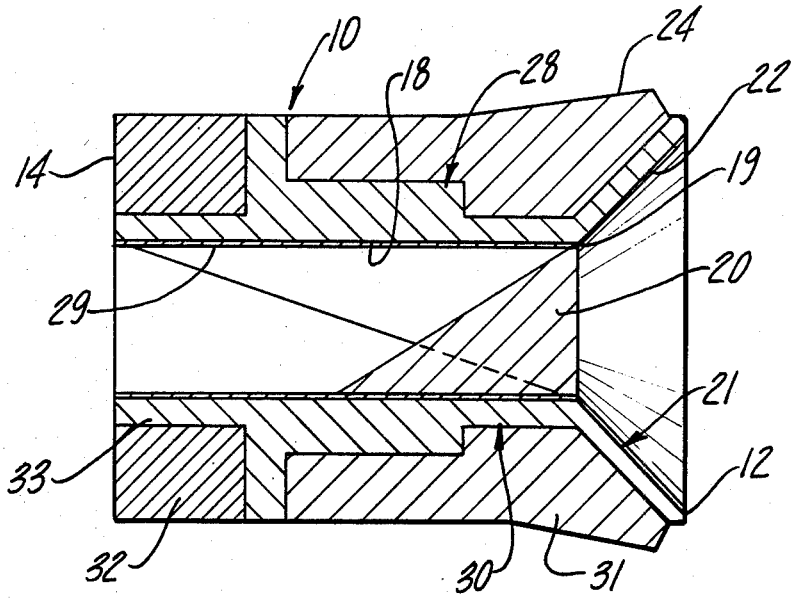
FIG. 3 is a longitudinal sectional view of the preferred embodiment of the present invention taken substantially along line 3—3 in FIG. 2 and enlarged for clarity.

With reference now to FIGS. 1–3, an axial throughbore 18 is formed through the body 10 from the front end 12 and to the rear end 14 of the body 10. A helical fin 20 is contained within and extends across the throughbore 18 for a purpose to be subsequently described. This helical fin 20 extends from the rear end 14 and to a midpoint 19 (FIG. 3) spaced inwardly from the front end 12 of the body 10.

As best shown in FIG. 3, the throughbore 18 preferably flares outwardly as shown at 21 from the midpoint 19 and to the front end 12 of the body 10. The outwardly flared portion thus forms a conical and axially aligned surface 22 which is open at its wider end to the front end of the body 10 and at its narrower end to the throughbore 18.

With reference again to FIGS. 1 and 2, a plurality of circumferentially spaced exterior fins 24 are formed axially around the outer periphery 16 of the body 10 from the front end 12 and to a position spaced forwardly from the rear end 14 of the body 10. These exterior fins 24 are circumferentially equidistantly spaced from each other and are angled with respect to the axis of the body 10. Furthermore, the exterior fins 24 are angled with respect to the axis of the body 10 by the same angle as the helical fin 20. Preferably this angle is substantially 11°.

With reference now particularly to FIG. 3, although the projectile of the present invention can be constructed in any fashion, it preferably includes an elongated tubular frame 28 which is constructed of a rigid material such as steel. A forward portion 30 of the frame 28, as well as a thin layer 29 on the interior of the axial throughbore 18, are then covered (e.g. by casting) with a soft and heavy material 31 such as lead. Preferably, both the helical fin 20 and exterior fins 24 are also formed from the same soft and heavy material. A cylindrical ring 32 is then secured around a rear portion 33 of the frame 28.

In operation, upon discharge of the projectile from the shotgun, the conical surface 22 of the body 10 both compresses and forces air through the throughbore 18. In doing so, the airflow through the throughbore 18 coacts with the helical fin 20 and imparts spin to the body 10. Simultaneously, the airflow around the outer periphery 16 of the body 10 coacts with the exterior fins 24 also to impart spin to the body 10. Since the body 10 spins during flight, its aerodynamic stability is greatly increased, thus increasing its long range accuracy. Furthermore, since the frame 28 is constructed of a rigid material, it prevents deformation of the shape of the body 10 upon discharge from the shotgun.

Although the ammunition projectile of the present invention has been described for use with a shotgun, it will be understood that it can alternatively be used with other types of firearms. Furthermore, although in the preferred form of the invention, the body 10 includes the internal frame 28, the projectile can be manufactured by any of a number of different processes.

Having described our invention, however, many modifications thereto will become apparent to those skilled in the art to which it pertains without deviation from the spirit of the invention as defined by the scope of the appended claims.

We claim:

1. An ammunition projectile comprising an elongated cylindrical body having an axis and an axial cylindrical throughbore, a helical fin contained within said throughbore for spinning said body about its longitudinal axis during flight of said body, said helical fin being angled to spin said body in a first rotational direction during flight;

a plurality of exterior fins, said exterior fins being secured to and circumferentially spaced around an outer periphery of said body, said exterior fins being angled with respect to the axis of said body so that said exterior fins spin said body in said first rotational direction during flight, wherein said body has a forward end and a rearward end, wherein said throughbore flares outwardly from a position spaced inwardly from said forward end and to said forward end of said body to form a conical surface, and wherein said helical fin extends only between said rearward end of said body and said inwardly spaced position.

2. The invention as defined in claim 1 wherein the angle of said helical fins and said exterior fins are substantially the same.

3. The invention as defined in claim 2 wherein said angle is substantially eleven degrees.

4. The invention as defined in claim 1 wherein said body comprises a tubular frame constructed of a rigid material.

5. The invention as defined in claim 1 wherein said projectile is a shotgun projectile.

* * * * *